United States Patent [19]

Novak

[11] 3,936,785

[45] Feb. 3, 1976

[54] GAS TUBE ARRESTER SUBASSEMBLY

[75] Inventor: Gary W. Novak, Des Plaines, Ill.

[73] Assignee: Cook Electric Company, Morton Grove, Ill.

[22] Filed: Jan. 15, 1975

[21] Appl. No.: 541,125

Related U.S. Application Data

[63] Continuation of Ser. No. 456,778, April 1, 1974, abandoned.

[52] U.S. Cl. ..... 337/29; 317/61.5; 317/71; 337/32; 337/34

[51] Int. Cl.[2] ..... H01H 61/00; H01H 39/00

[58] Field of Search ..... 337/28, 29, 32, 34, 35; 317/68, 61.5, 69, 16, 66, 71; 339/147 R, 147 P; 313/243, 246, DIG. 5

[56] References Cited

UNITED STATES PATENTS

| | | | |
|---|---|---|---|
| 2,546,824 | 3/1951 | Koliss | 337/34 X |
| 2,619,518 | 11/1952 | Kelsay | 337/32 X |
| 3,255,330 | 6/1966 | MacKenzie et al. | 337/34 X |
| 3,522,570 | 8/1970 | Wanaselja | 337/32 X |
| 3,524,107 | 8/1970 | Reitz | 317/68 X |
| 3,543,207 | 11/1970 | Kawieki | 337/34 X |
| 3,573,695 | 4/1971 | Geyer et al. | 337/32 X |
| 3,587,021 | 6/1971 | Baumbach | 337/32 |
| 3,743,888 | 7/1973 | Baumbach | 337/32 X |
| 3,798,505 | 3/1974 | Reckard et al. | 337/34 X |
| 3,818,271 | 6/1974 | Baumbach | 337/32 X |

*Primary Examiner*—Arthur T. Grimley
*Attorney, Agent, or Firm*—Mason, Kolehmainen, Rathburn & Wyss

[57] ABSTRACT

A gas tube arrester subassembly for use in a modular component type telephone central office protection system includes a gas tube arrester having a spacer tube with an electrode at each end. One of the electrodes is insertable into an open end of a generally cylindrical shell portion of the gas tube arrester subassembly with parts of the shell portions at the open end being swaged to form securing members to maintain the one electrode in the shell portion. The other end of the shell portion is closed with a generally rectangular slot therein. Removably mounted in the slot is a conductive U-shaped spring member such that the spring member has one leg extending along the inner surface of the closed end. Disposed between the one leg and the one electrode is a conductive disk-shaped contact member to couple the one electrode to the spring member.

18 Claims, 4 Drawing Figures

GAS TUBE ARRESTER SUBASSEMBLY

The present application is a continuation application of patent application Ser. No. 456,778, filed on Apr. 1, 1974, and now abandoned.

The present invention relates to protection systems in a telephone central office and, more particularly, to a new and improved gas tube arrester subassembly which is employed in modular component type of protection systems in a telephone central office.

In a telephone central office, each of the outside lines or cables that is terminated at the central office must be protected such that high voltages and sneak currents occurring on such lines or cables do not damage central office equipment and/or injure operating personnel. One type of protection system that so protects the lines incorporates modular components so that the system occupies a minimum amount of space, provides versatile types of protection functions and facilitates operating and repair procedures. This modular type of protection system consists primarily of a plurality of terminal receptacles mountable on main frame mounting bars located in a telephone central office. Each terminal receptacle is capable of receiving two plug-in type protector modules, each of which provides various protection functions for a pair of tip and ring cables or lines. These protector modules can be rapidly replaced or interchanged with a minimum amount of effort and expense.

Each of the modular plug-in protector modules can contain various types of protection devices to provide the various protection functions. For instance, the plug-in protector module may contain a heat coil unit for each of the lines that isolates the central office equipment during overload conditions and that activates alarm circuits, if desired. Normally, these heat coil units are resettable by plungers projecting from the protector modules. In addition, the protector modules may contain arrester subassemblies to ground the outside lines or cables if high voltages or sneak currents occur on those lines. The arrester subassemblies are readily mounted in small compartments provided in the protector module such that each arrester is electrically inserted between a terminal contact coupled to an outside line and a grounded terminal contact.

In the past, gas tube type arrester subassemblies used in these protector modules consisted of non-fail-safe glass button tubes that were mounted in appropriate holders. More recently, it has become advantageous to utilize standard type gas tube arresters that provide for internal fail-safe operation in the event a sustained overvoltage or sneak current condition occurs on a telephone line. However, these standard type gas tube arresters must still be easily mountable in the protector modules.

Accordingly, objects of the present invention are to provide a new and improved gas tube arrester subassembly that can utilize standard gas tube arresters having fail-safe capabilities; that is relatively inexpensive and simple to produce; that is readily mountable in protector modules of a modular component type telephone central office protection system; that is easily assembled with substantially nonflammable type materials; and that provides both good heat transfer and electrical paths between the gas tube arrester and the telephone office protection system.

In accordance with these and many other objects of the present invention, an embodiment of the present invention includes a gas tube arrester subassembly which is mounted between a line terminal contact and a ground contact in a small compartment of a protection module forming a part of a modular component type protection system. The subassembly includes a standard type gas tube arrester consisting of an insulating spacer tube with a cupshaped end cap and stem or rod portion projecting therefrom to form an electrode at each end of the spacer tube. The subassembly also includes a generally cylindrical shell portion or container having one end substantially closed except for a relatively narrow slot and the other end substantially open. One leg portion of a conductive, generally U-shaped spring member is insertable through the slot such that the one leg portion extends along the inner surface of the closed end. The other leg portion extends away from the outer surface of the closed end. Located adjacent the one leg portion within the shell portion is a conductive, generally disk shaped contact member having a centrally located notch in the surface adjacent the open end of the shell portion. One electrode of the gas tube arrester is insertable into the open end of the shell portion and is rotatably secured in the shell portion by swaging portions of the open end of the shell portion about the end cap of the one electrode. Upon insertion of the gas tube arrester subassembly between the line terminal contact and the ground contact, the spring member forces the stem portion of the other electrode against one of the contacts and the stem portion of the one electrode is forced into the notch disposed in the contact member and against the contact member so that an electrical and heat thermal path is formed between the one stem portion through the contact and spring members to the other contact.

Many other objects and advantages of the present invention will become apparent from considering the following detailed description in conjunction with the drawings in which.

Figure 1:
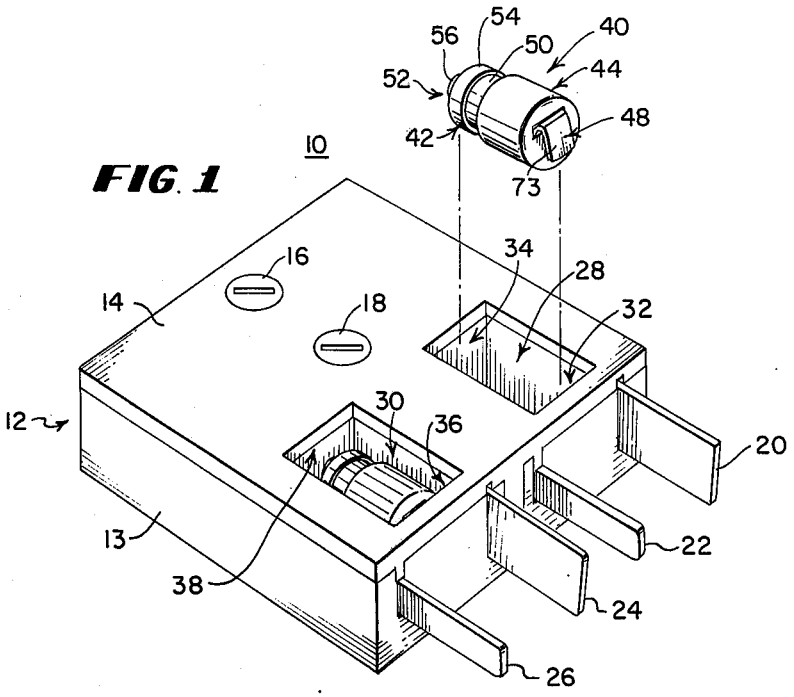
FIG. 1 is a perspective view of a protector module with one gas tube arrester subassembly embodying the present invention mounted in a small compartment of the protection module and with a second gas tube arrester subassembly positioned adjacent another small compartment in the protector module to illustrate the insertion of the arrester subassembly into the compartment.

Referring now to FIG. 1 of the drawings, therein is disclosed a protector module 10 that is utilized in a modular component type protector system in a telephone central office. The protector module 10 has a generally rectangular shaped housing 12 with base portion 13 and a cover or lid 14 secured to the base 13 by a pair of set screws 16 and 18. Extending from one side portion of the protector module 10 are terminals 20, 22, 24 and 26. The terminals 20 and 24 are normally connected to a pair of outside telephone lines terminated at the telephone central office, whereas the terminals 22 and 26 are coupled to the terminals 20 and 24, respectively, in the protector module 10 and to telephone central office equipment. In order to protect the central office equipment coupled to the terminals 22 and 26 from high voltages or sneak currents that might occur on the outside telephone lines coupled to the terminals 20 and 24, the protector module 10 contains various protection devices to provide the modular component type protection system with various protection functions.

For instance, the protector module 10 may contain heat coil devices that are coupled between the terminals 20 and 22 or between the terminals 24 and 26 such that when an overvoltage condition occurs, the heat coil device will isolate the terminal 20 from the terminal 22 or the terminal 24 from the terminal 26 so that the central office equipment coupled to the terminals 22 and 26 will not be damaged due to the overvoltage condition. In addition, the heat coil devices may actuate alarm circuitry when such an overvoltage condition occurs. Normally, these heat coil devices are resettable by means of plungers that extend from the housing 12 when the heat coil device is actuated due to an overvoltage condition.

In addition, the protector module 10 has a pair of relatively small compartments 28 and 30 that are accessible through the lid or cover 14. At one end of the compartment 28 is a line terminal contact 32 that is directly coupled to the terminal 20. At the other end of the compartment 28 is a ground terminal contact 34 that is coupled to a main frame ground bar (not shown) in the telephone central office through the modular component system. Similarly, the compartment 30 has a line terminal contact 36 coupled to the terminal 24 and a ground terminal contact 38 coupled to the main frame grounding bar. Each of the compartments 28 and 30 is capable of receiving a gas tube arrester subassembly which is generally indicated at 40 and which embodies the present invention. The gas tube arrester subassembly 40 provides fail-safe protection for the line coupled to the terminal 20 when inserted in the compartment 28 and for the line coupled to the terminal 24 when inserted in the compartment 30.

Figure 3:
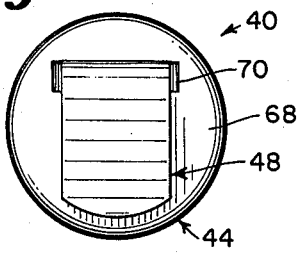
FIG. 3 is an end plan view of the subassembly of FIG. 2 as viewed from the left side of FIG. 2.
Figure 2:
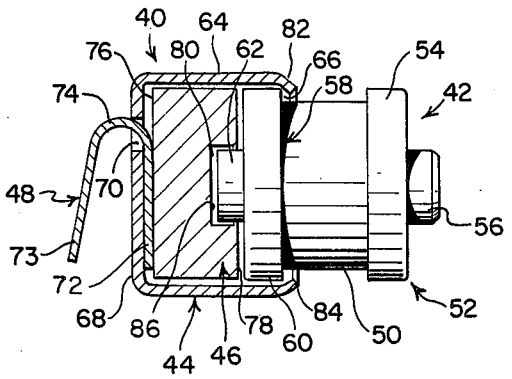
FIG. 2 is a side elevation view of a gas tube arrester subassembly of the type shown in FIG. 1 with the portions of the subassembly other than the gas tube arrester shown in cross-section.
Figure 4:
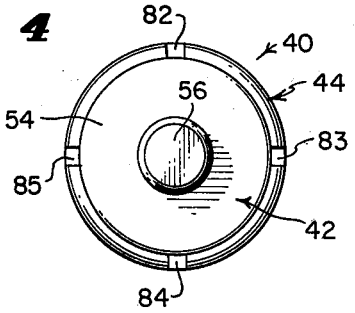
FIG. 4 is another end view of the subassembly of FIG. 2 as viewed from the right side of FIG. 2.

More specifically and as shown in FIGS. 2–4, the gas tube arrester subassembly 40 includes a gas tube arrester 42, a shell or container portion 44 into which the gas tube arrester 42 is insertable, a contact member 46 disposed within the shell portion 44, and a spring member 48. The gas tube arrester 42 is a standard type of gas tube arrester having an insulating spacer tube 50 made of ceramic or the like. At one of the spacer tubes 50 is an electrode 52 formed of a cup-shaped, relatively thin cross-sectional metal end cap 54 and a solid metal stem or rod portion 56. At the other end of the spacer tube 50 is a similar electrode 58 consisting of a cup-shaped, relatively thin cross-sectional metal end cap 60 and a solid metal stem portion 62. The stem portions 56 and 62 extend into the spacer tube 50 so as to form a spark gap between the stem portions 56 and 62.

The gas tube arrester 42, in particular, the electrode 58 and a portion of the spacer tube 50, is insertable into the shell portion 44. The shell portion 44 is formed of a generally cylindrically shaped, conductive container or housing 64 made of brass or the like. One end portion 66 of the container 64 is substantially open whereas another end portion 68 is substantially closed. The closed end portion 68 has a generally rectangular, narrow slot 70 so that a portion of the spring member 48 is removably insertable into the interior of the container 64.

The spring member 48 is conductive, being made of copper or the like. As is apparent from FIGS. 1–3, the spring member 48 is generally U-shaped such that is has leg portions 72 and 73 extending from a bight portion 74. When the spring member 48 is inserted through the slot 70, the leg portion 72 extends along or adjacent the inner surface of the closed end portion 68 of the container 64. The other leg portion 73 of the spring member 48 is then positioned near the outer surface of the closed end portion 68.

Disposed in the shell portion 44 between the leg portion 72 and the open end 66 of the shell portion 44 is the contact member 46. The contact member 46 is generally disk-shaped and is made of an appropriate conductive material such as brass or the like. One side 76 of the contact member 46 is disposed adjacent to the leg portion 72 of the spring member 48. Another side portion 78 of the contact member 46 has a centrally located, generally cylindrical notch 80. The contact member 46 provides the electrical and thermal path between the stem portion 62 of the gas tube arrester 42 and the spring member 48.

More specifically, the electrode 58 and a small portion of the spacer tube 50 of the gas tube arrester 42 are insertable into the open end 66 of the shell portion 44. These portions of the gas tube arrester 42 are secured in the shell portion 44 by swaging portions of the open end portion 66 of the container 64 to form holding or securing members 82–85 about the end cap 60 of the electrode 58. Since the end cap 60 is slightly smaller in diameter than the container 64, the gas tube arrester 42 is free to rotate in the shell portion 44 and is free to move laterally along the longitudinal axis of the container 64 between the contact member 46 and the holding members 82–85.

As previously indicated, the gas tube arrester subassembly 40 is insertable into the small compartments 28 and 30 in the protector module 10. As illustrated in FIG. 1 in connection with the gas tube arrester subassembly 40 and the compartment 28, the gas tube arrester subassembly 40 is easily insertable into either of the compartments 28 or 30 through the opening in the cover 14 above the compartments 28 or 30. When the gas tube arrester subassembly 40 is so inserted into the compartment 28, the stem portion 56 of the electrode 52 is forced against the ground terminal contact 34 and the spring member 48 is forced against the line terminal contact 32.

With the gas tube arrester subassembly 40 inserted between the contacts 32 and 34, the spring member 48 is compressed such that the leg 73 is forced toward the outer surface of the closed end portion 68 of the shell portion 44. Because of the compression of the spring member 48 in this manner, the gas tube arrester 42 is forced to move laterally into the shell portion 44 (toward the left in FIG. 2) such that the stem portion 62 is forced into the notch 80 in the contact member 46 and abuts against a bottom surface 86 of the notch 80. In this manner, the contact member 46 directly couples the stem portion 62 of the electrode 58 to the spring member 48. Thus, the stem portion 62 is electrically and thermally coupled to the line terminal contact 32 through the contact member 46 and the spring member 48.

In the event that a high voltage or sneak current occurs on the outside cable or line coupled to the terminal 20, the high voltage or sneak current will be applied to the line terminal contact 32 and coupled through the spring member 48 and the contact member 46 to the electrode 58 of the gas tube arrester 42. If the high voltage or sneak current is of sufficient magnitude, the spark gap formed between the electrode 52 and 58 in the spacer tube 50 will spark over and a short circuit will be formed between the stem portions 56 and 62. Since the stem portion 56 is directly coupled to the ground terminal contact 34, the high voltage or sneak current will be dissipated to ground through the main frame ground bar to which the ground terminal contact 34 is coupled.

In this manner, any high voltages or sneak currents that occur on the line coupled to the terminal 20 will be coupled to ground rather than to the terminal 22 so that any central office equipment coupled to the terminal 22 will not be damaged. In a similar manner, the gas tube arrester subassembly 40 located in the compartment 30 between the contact members 36 and 38 protects the central office equipment coupled to the terminal 26 from any high voltages or sneak currents occuring on the line coupled to the terminal 24.

It should be noted that the gas tube arrester 42 is the type that has internal fail-safe capabilities. Thus, in the event that a high voltage or sneak current condition persists for a predetermined period of time, the spark gap between the electrodes 52 and 58 will permanently short over. The line connected to the terminal 20 or the terminal 24 then will be continuously grounded such that the equipment coupled to the terminal 22 or the terminal 26, respectively, will not be damaged even if the high voltage or sneak current condition persists for a long period of time.

The structure of the gas tube arrester subassembly 40 also facilitates the easy manufacture of such a subassembly. Before the assembly of the gas tube arrester subassembly 40, the shell portion 44 is completely open at its open end portion 66 and does not have the holding or securing members 82–85. The leg portion 72 of the spring member 48 is easily inserted through the slot 70 in the closed end portion 68 of the shell portion 44. The contact member 46 as well as the electrode 58 and a portion of the spacer tube 50 of the gas tube arrester 42 are then inserted through the open end 66 of the shell portion 44. Thereafter, the portions of the container 64 at the open end 66 are swaged about the end cap 60 of the electrode 58 so as to form the securing members 82–85.

Moreover, the positioning of the gas tube arrester subassembly 40 between the contacts 32 and 34 or the contacts 36 and 38 enable any heat generated during a power cross to be dissipated by the heat sinks formed by the protection system to which the contacts 32, 34, 36 and 38 are coupled. In particular, the heat generated in the gas tube arrester 42 during a power cross tends to be dissipated through the solid metal stem portions 56 and 62 rather than the relatively thin metallic end caps 54 and 60 of the electrodes 52 and 58, respectively. Since the stem portion 56 is directly coupled to the ground terminal contact 34 or 38, the heat generated during the power cross can be dissipated by the adequate heat transfer path provided between the stem portion 56 and the contacts 34 or 38.

In the same manner, the heat generated at the stem portion 62 can be dissipated to the protection system because the stem portion 62 is in intimate contact with the contact member 46, which in turn, is in intimate contact with the spring member 48. Since the contact member 46 and the spring member 48 have adequate heat transfer characteristics, any heat generated at the stem portion 62 is adequately dissipated. This is particularly important so that the seal between the end caps 54 and 60 and the spacer tube 50 are not damaged during power crosses so that the gas tube arrester 42 can be used as a fail-safe protection device.

In addition, the entire gas tube arrester subassembly 40 is made of nonflammable material. If any component of the gas tube arrester subassembly 40 was not made of such nonflammable material, the gas tube arrester subassembly 40 could be considerably damaged during power crosses because the temperature during such conditions could attain approximately 1300° F.

Although the present invention is described with reference to a single illustrative embodiment thereof it should be understood that numerous other modifications and embodiments of the invention can be devised by those skilled in the art that will fall within the spirit and scope of the principles of this invention.

What is claimed as new and desired to be secured by Letters Patent of the United States is:

1. An arrester subassembly having an arrester with an electrode at one end, said arrester subassembly further comprising:

a shell portion having one end substantially closed and one end substantially open, said shell portion having securing means at said open end to secure said electrode in said shell portion;

a spring means removably mounted on said shell portion at said closed end of said shell portion; and a contact means disposed in said shell portion between said spring means and said electrode.

2. The arrester subassembly as set forth in claim 1 wherein said shell portion is substantially cylindrical in shape and said securing means are formed at said open end by swaging portions of said cylindrical shell portion at said open end.

3. The arrester subassembly as set forth in claim 1 wherein said shell portion has a slot in said closed end to receive said spring means and said spring means is generally U-shaped with a first leg portion extending through said slot along the inner surface of said closed end of said shell portion and a second leg portion extending away from the outer surface of said closed end.

4. The arrester subassembly as set forth in claim 1 wherein said contact means is generally disk-shaped with a notch in one side to receive a portion of said electrode when it is positioned in said shell portion.

5. The arrester subassembly as set forth in claim 1 wherein said shell portion, said spring means, and said contact means are metal and conductive.

6. An arrester subassembly having an arrester with a spacer tube and an one electrode at one end of said spacer tube, said electrode including an end cap and a stem portion extending from said end cap, said gas arrester subassembly further comprising:

a container means having one end substantially closed, said container means being adapted to rotatably receive said end cap and said stem portion; and a biasing means removably mounted through said closed end of said container means, said biasing means being coupled to said stem portion.

7. The arrester subassembly as set forth in claim 6 including a contact means disposed between said stem portion and said biasing means to couple said stem portion to said biasing means.

8. In combination with a plug-in type protector module having compartments with a pair of opposed contacts, a gas tube arrester subassembly to be inserted between said contacts, said gas tube arrester subassembly comprising:

a gas tube arrester formed of a spacer tube having a first electrode at one end and a second electrode at the opposite end of the spacer tube, said first electrode having a first end cap and a first stem portion and said second electrode having a second end cap and a second stem portion;

a container means having one end substantially closed and one end substantially open, said container means having holding means to secure said second electrode in said container means;

a contact means disposed in said container means; and a spring means removably mounted at said closed end of said container means, said spring means being forced against one of said contacts when said subassembly is inserted into said compartment such that said first stem portion is forced against said other contact and said second stem portion is forced against said contact means so that said spring means is coupled to said second stem portion through said contact means.

9. The combination as set forth in claim 8 wherein said container means is generally cylindrical and has a slot in said closed end through which said spring means in mounted.

10. The combination as set forth in claim 9 wherein said contact means is disk shaped having a diameter slightly smaller than the inside diameter of said container means and having a notch at one end aligned with said second stem portion.

11. The combination as set forth in claim 8 wherein said holding means are formed by swaging portions of said container means about said second end cap.

12. An arrester subassembly having an arrester with an electrode at one end, said arrester subassembly further comprising:

a shell portion having a first end substantially open, said shell portion having securing means at said open end to secure said electrode in said shell portion;

a spring means on said shell portion at an opposite second closed end of said shell portion; and a contact means disposed in said shell portion between said spring means and said electrode.

13. The arrester subassembly as set forth in claim 12 wherein said shell portion is substantially cylindrical in shape and said securing means are formed at said first open end by swaging portions of said cylindrical shell portion at said open end.

14. The arrester subassembly as set forth in claim 12 wherein said contact means is generally disk-shaped with a notch in one side to receive a portion of said electrode when it is positioned in said shell portion.

15. An arrester subassembly having an arrester with a spacer tube and an one electrode at one end of said spacer tube, said gas arrester subassembly further comprising:

a container means having one end substantially open, said container means being adapted to rotatably receive said electrode in said open end; and a biasing means mounted at said other end of said container means, said biasing means being coupled to said one electrode.

16. The arrester subassembly as set forth in claim 15 including a contact means disposed between said one electrode and said biasing means to couple said one electrode to said biasing means.

17. In combination with a plug-in type protector module having compartments with a pair of contacts, a gas tube arrester subassembly to be inserted between said contacts, said gas tube arrester subassembly comprising:

a gas tube arrester formed of a spacer tube having a first electrode at one end and a second electrode at the opposite end of the spacer tube, a container means having one end substantially open, said container means having holding means to secure said second electrode in said container means;

a contact means disposed in said container means; and a spring means coupled to said second electrode by said contact means and positioned between said container means and one of said contacts to position said subassembly in said compartment such that said second electrode is coupled to said one contact and said first electrode is coupled to the other of said contacts.

18. The combination as set forth in claim 17 wherein said holding means are formed by swaging portions of said container means about said second electrode.

* * * * *